US005881481A

United States Patent [19]

Bashaw, Jr. et al.

[11] Patent Number: 5,881,481

[45] Date of Patent: Mar. 16, 1999

[54] MESSAGE DISPLAY SYSTEM

[76] Inventors: Thomas P. Bashaw, Jr., 9803 S. Venneford Ranch Rd., Highlands Ranch, Colo. 80126; William M. Bashaw, 7504 East Sunset Trail, Parker, Colo. 80134

[21] Appl. No.: 800,474

[22] Filed: Feb. 14, 1997

[51] Int. Cl.[6] ..... G09F 21/04

[52] U.S. Cl. ..... 40/593; 116/173; 40/591; 40/597

[58] Field of Search ..... 40/593, 591, 218, 40/597; 116/173

[56] References Cited

U.S. PATENT DOCUMENTS

| | | | |
|---|---|---|---|
| 2,775,221 | 12/1956 | Olson | 116/173 |
| 3,119,370 | 1/1964 | Keats | 116/173 |
| 3,127,869 | 4/1964 | Howland | 116/173 |
| 3,138,249 | 6/1964 | Paulini | 116/173 XO |
| 3,500,789 | 3/1970 | Keats | 116/173 |
| 4,590,883 | 5/1986 | Steed et al. | 117/173 |

*Primary Examiner*—Cassandra H. Davis
*Attorney, Agent, or Firm*—Ramon L. Pizarro; Edwin H. Crabtree

[57] ABSTRACT

The disclosure describes a display system with at least one interchangeable substantially planar display, a resilient support made of resilient sheet material to support the planar display, and a support for holding the resilient support against a support surface. A resilient rod is preferably used with the system. The resilient rod can be used to cooperate with the resilient support to allow mounting of the planar display at a distance from the rod.

14 Claims, 3 Drawing Sheets

MESSAGE DISPLAY SYSTEM

BACKGROUND OF THE INVENTION (a) Field of the Invention

This invention generally relates to a method and a system for creating and displaying a message, but not by way of limitation, to a system for creating and supporting messages from a substantially flat surface.

(b) Discussion of Known Art

The need and desire to display a printed message as a form of expression has long been recognized. Particularly, it has long been recognized that while it is desirable to be able to display messages to other individuals, it is also very important to be able to draw or capture the attention of the people for whom the message is directed. Moreover, since different individuals or entities may want to display or draw attention to drastically different messages and subject matter. Thus, there is a need for a system that allows personal expression in the creation and display of messages. To cater to these needs several examples of the known prior art have contributed different approaches at solving some of the problems associated with creating, displaying, and conveying written or message indicia to others.

For example in U.S. Pat. No. 4,873,643 to Powell et al. a system for creating custom imprinted articles is taught. The Powell system uses an interactive design terminal for using stored designs and using these designs as part of custom designs to be printed on garments.

In another example found in U.S. Pat. No. 4,352,461 to Orta et al. a hand signal and air freshener device is taught. The Orta device, which primarily serves as an air freshener, advantageously uses the weight of a freshener container to impart a rocking motion to a container mounted on a flexible rod to dispense air freshener.

Yet another example of a display system can be found in U.S. Pat. No. 3,168,276 to Schneider. The Schneider device includes a recipe card holder which allows the variation of the recipe cards to be held by a cantilevered support. The Schneider device offers the versatility of allowing the user to vary the card displayed, but is not particularly well suited for mounting in a variety of areas, such as to the interior of a car, for example.

An example of a signal system can be found in U.S. Pat. No. 3,007,435 to Peterson. The Peterson device includes a suction cup and a display that can be used to signal one of two messages to oncoming motorists. The Peterson device is of limited versatility since it is not readily modifiable so as to allow users to create a variety of displays. The Peterson device allows the display of a single card or color, and depends primarily on the color being displayed to communicate a message.

In U.S. Pat. No. 2,277,981 to Horton a display device for attachment to a vehicle head lamp is taught. The Horton device includes a support portion that can include a light reflecting device in order to use the light from the headlight to illuminate the display. The Horton device also suffers from a lack of versatility, since it is designed to carry a single display. Moreover, the Horton device does not lend itself to positioning and display on a variety of surfaces.

In U.S. Pat. No. 1,741,434 to Pratt et al. teaches the use of a suction cup to support a telephone sign, the suction cup also providing the appearance of a mouthpiece on the sign. The Pratt device serves the purpose of announcing that a telephone may be found on the premises, but does not allow the user to vary the message to be displayed.

Thus, from the above discussion it becomes clear that there remains a need for an easy to use, versatile, and highly impactful system that allows the user to develop personalized messages. The known prior art provides systems that allow a single sign or message to be placed on some sort of support, but that do not allow the user to customize or vary the message sent. The known prior art fails to provide placement versatility, including allowing the user the option to present a display from positions on the inside or on the outside of a window glass or any other flat or transparent surface. The ability to place the display on the inside of a vehicle extends the useful life of the display by preventing deterioration of the display by the elements.

Still further, it is recognized that a flag or banner is particularly useful in drawing the attention of a passer-by since it is understood, by cultural convention, that the flag or banner will include some sort of message. Thus the flag or banner arouses the curiosity of the passer-by who wants to and expects to find a message on the flag or banner. However, to date the versatility and ease of varying the message on the flag or banner has been limited, since these flags or banners can only carry a single, unmodifiable, display.

Also, the known prior art provides devices that allow the user to place the signs or displays at a single, pre-determined location. For example, with the Peterson or Horton devices, the user must place the display device at a specific location on a vehicle.

Other known display devices, such as bumper stickers or decals, must be placed on surfaces which can tolerate scratching in case the user wants to remove the sticker or decal. Alternatively, the stickers or decals must be placed on a surface which is not aesthetically important where scraping or glue residue may be tolerated. A limitation to the use of these locations or surfaces is that they are typically out of the way or not directly on the normal line of sight of the observer. Thus, these stick on, or adhesive supported displays, suffer from the limitation that they cannot be conveniently placed on surfaces that must hold high quality finishes without negatively impacting the surface finish quality.

Still further, the use of displays that are secured by an adhesive creates problems such as unsightly weathering and aging of the sticker itself. Thus, there remains a need for a device that can be easily replaced or removed and stored away from the elements in order to protect the display from weathering.

There remains a need for a system that can be placed at eye level, without harming the mounting surface and which allows variation of the message to be displayed. Still further, there remains a need for a system that is light weight and can be easily assembled to produce a consistent, impactful and professional appearance as to alignment and presentation.

SUMMARY

It has been discovered that the problems and needs left unsolved by the known prior art can be met by providing a display system that includes the following elements:

(a) at least one interchangeable substantially planar display;

(b) a resilient support made of resilient sheet material to support the planar display; and (c) means for supporting the resilient support against a support surface.

It has also been discovered that in addition to the above components, it is highly desirable to include a resilient rod to the system. The resilient rod can be used to cooperate with the resilient support to allow mounting of the planar display at a distance from the means for supporting the resilient support.

Still further, another aspect of the instant invention includes a method for creating and displaying messages, the method includes the following steps:

a) providing at least one substantially planar display, a resilient rod, means for supporting said resilient rod against a support surface, and a resilient support means for supporting said planar display from said resilient support rod, the resilient support means comprising a sheet of resilient material having a longitudinal fold line that divides the sheet into two legs of substantially equal areas having opposing faces, each opposing face having at least one section of adhesive material;

b) placing the planar display against the section of adhesive material of one of the legs of the resilient support means;

c) pressing the section of adhesive material of the opposing face against the planar display, so that the two opposing faces adhere to the planar display and define an aperture between the two opposing faces; and e) inserting the resilient rod into the aperture defined between the two opposing faces of the resilient support means.

In a preferred embodiment of the invention, the resilient rod is made from a translucent material which has an index of refraction that allows the rod to capture light to enhance the visibility and attention getting qualities of the invention. It has been found that translucent fluorescent rods serve these purposes very well. Also, it has been discovered that a resilient rod vibrates, further drawing attention to the display. Yet another advantage of the use of a resilient rod is that the rod may be bent or shaped to press the display against curved or angled surfaces, such as the inside of the window of a car.

It is also contemplated that the resilient rod be filled with a chemiluminescent material, as found in chemiluminescent lighting devices or light sticks. These devices typically include at least two sealed compartments. Each compartment containing one of two chemical components, which when mixed react to produce chemical light. Devices of this type are shown in U.S. Pat. Nos. 3,576,987, 4,508,642, or 4,193,109.

The resilient support that is used to support the planar display on the resilient rod is preferably made from tabbing material, of the type frequently used to hold index tabs on separators on binders. It has been found that a particularly well suited tabbing is made by the Avery Dennison Corporation of California. The tabbing device includes a resilient sleeve section and a pair or legs with adhesive surfaces.

In a preferred embodiment of the instant invention a flat display may be inserted and held by the adhesive between the legs of the tabbing device. Once the flat display is secured between the legs of the tabbing material, the resilient sleeve may then be placed over and around the resilient rod, and slid to adjust the display to the desired position along the rod. It has been discovered that by using the tabbing as a means for attaching the flat display one can achieve consistent, aligned, uniform, and parallel placement of the display on the resilient rod. Also, since the sleeve grips the resilient rod by friction induced by pressure, the use of the tabbing material allows the user to replace or adjust the location of the display with minimal effort and harm to the display. Still further, it has been discovered that a resilient shim material may also be used in conjunction with the tabbing material in order to further enhance the grip on the resilient rod, while still maintaining the removability and versatility of the system.

Another important advantage to the use of a flat display in conjunction with the tabbing material is that this combination allows the user to incorporate ordinary paper or cardstock material as the signage. This is a significant advantage since it allows the use of the personal computer in making the signs. It is contemplated that software offering a menu with options that allow one to select from a variety of designs would allow the user to customize the display to be placed on the flat panel. This would obviate the need for specially-made, "factory-ordered" flat panels or signs with adhesive backing. This allows the user to customize the material from which the signs are made and adds a new level of versatility that is not achievable with the prior art.

The resilient rod is preferably held against a support surface, such as the window of a car, side of a cooler at a supermarket, mirror at a home, office or business window, or other similar flat surface with a suction cup. The use of a suction cup is preferred due to its particularly benign effects on the surface from which the system is to be supported. Thus the use of a suction cup allows the user to easily remove the system from the mounting surface, without the need to scrape or clean the surface after the device is removed. Thus the use of the suction cup will prevent damage to painted or coated surfaces (such as tinted windows or bumpers on modern cars). Also, the use of a suction cup allows the user to routinely change the location where the system is mounted. This allows the user to place the sign in a convenient location where the user's view is not obstructed and visibility of the display maximized for all observers.

It will become apparent that the disclosed invention allows the user to place and vary the displays used with the system in order to display messages for political, educational, humorous, sales, advertising, environmental and other special interest communication needs. Thus the display system may be used to provide a platform which allows the user to vary a message to be given to the public. Therefore, while it is contemplated that the system may be used to display a sign in a car window, for example, the system may also be conveniently used by a restaurant to advertise the specials of the day, or by a supermarket to display featured merchandise on coupon or discount. The versatility of the device will allow the supermarket operator or restaurateur to place the signage at eye level and protruding from the support surface to enhance the effectiveness of the system.

While these and other advantages and objects of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

Figure 6:
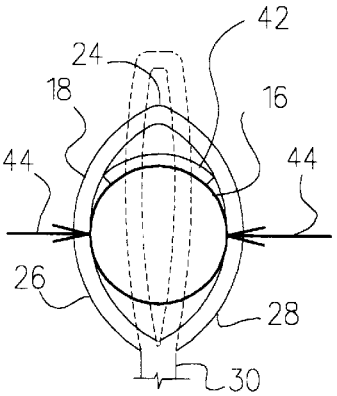

FIG. 6 is an enlarged view of means for supporting the display on the resilient rod as it holds the resilient rod, the view also illustrates the balanced, symmetrical gripping forces imposed by the means for supporting the display on the resilient rod and the use of a removable shim to further ensure a strong frictional grip exerting pressure on the resilient rod. The view also illustrates the geometric symmetry that allows consistent symmetrical assembly of the components onto the resilient rod.

Figure 6A:
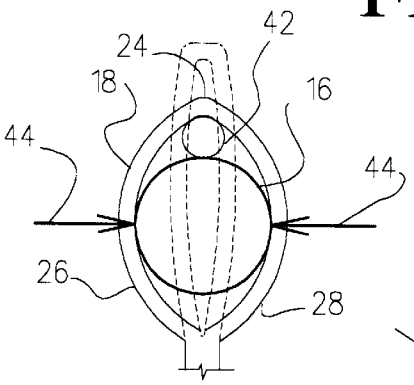

FIG. 6A is an enlarged view of means for supporting the display on the resilient rod as it holds the resilient rod, the view also illustrating the use of a rounded removable shim to further ensure a strong frictional grip exerting pressure on the resilient rod. The view also illustrates the geometric symmetry that allows consistent symmetrical assembly of the components on to the resilient rod as well as the effect of the balanced and symmetrical forces on the display, allowing even support of the display.

Figure 7:
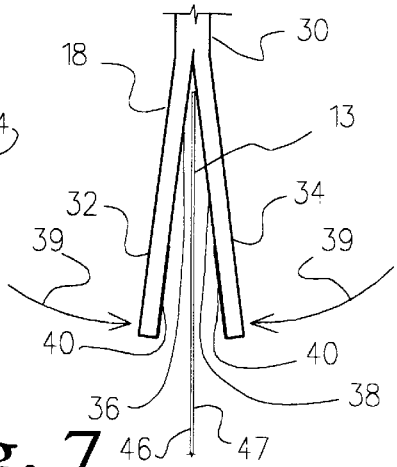

FIG. 7 is an enlarged view of the legs of the means for supporting the display on the resilient rod; the view also showing the adhesive surfaces on the inside of the legs exposed and including arrows indicating the direction of force to be exerted in order to grip the sign or display between the legs of the means for supporting the display on the resilient rod. The view also illustrates the important result of imposing equal, balanced forces to support the display in a properly aligned, and durable manner.

Figure 7A:
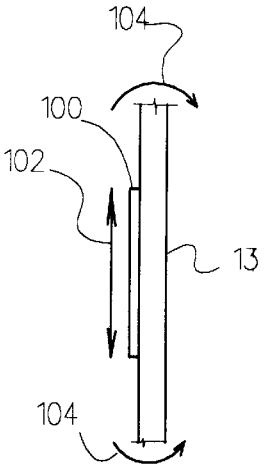

FIG. 7A illustrates the effects of unequal thermal expansion/contraction or other dimensional changes on the alignment of a flat display sign when two layers of dissimilar materials are joined; this same effect leads to separation of the two layers.

Figure 7B:
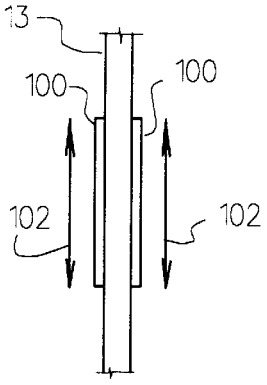

FIG. 7B illustrates the effects of a balanced buildup of layers about a central flat panel, such as a flat display. The effects of unequal thermal expansion/contraction or other dimensional changes are neutralized by the use of a similar material at a substantially equal distance from the center or neutral axis of the flat display sign.

Figure 8:
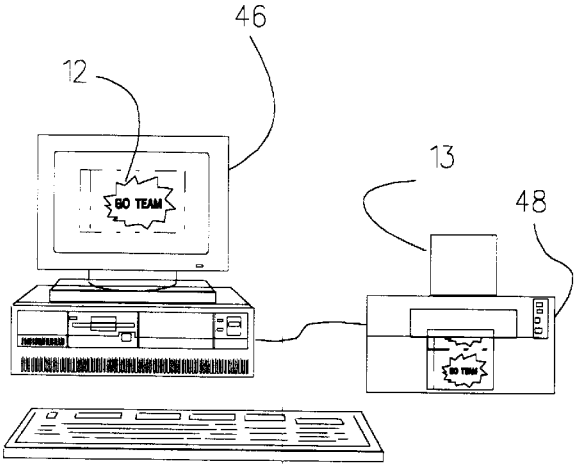

FIG. 8 illustrates the use of a computer to print on flat sheets of paper or other material that is to serve as the display or sign.

Figure 9:
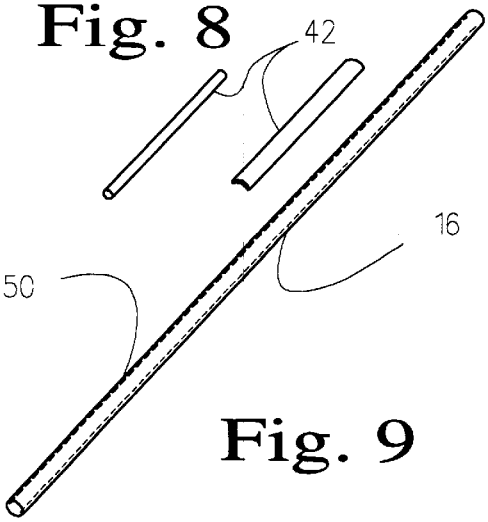

FIG. 9 illustrates the resilient rod and the removable shim.

Figure 10:
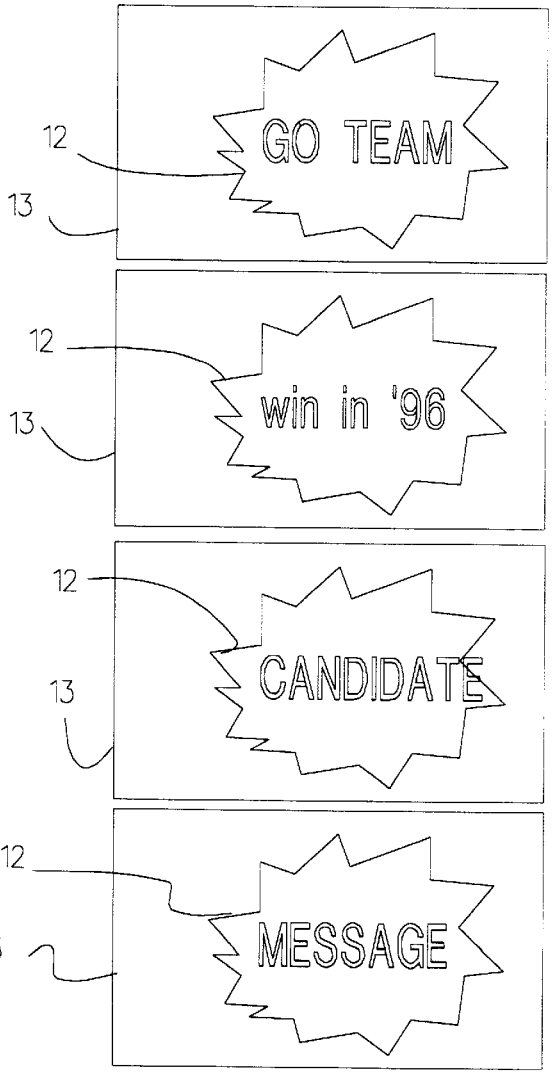

FIG. 10 illustrates a possible set of assorted signs or displays that may be sold together as part of a pre-prepared kit that contains a variety of displays. The kit would allow the user to select a display, color, or graphics from the assortment provided and customize the display on the system.

DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
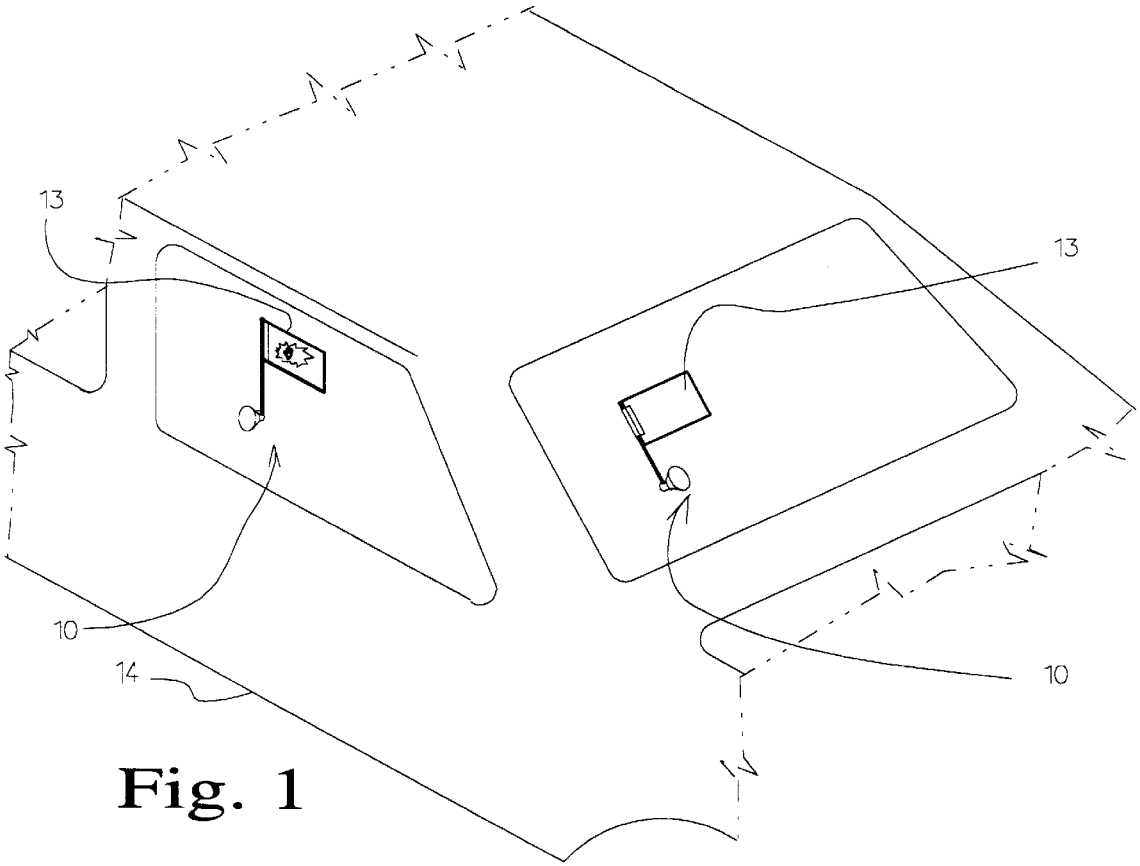
FIG. 1 is an illustration of possible uses and installations of the system on the interior or exterior of a vehicle.

Turn now to FIG. 1 which shows the message display system 10. The message display system serves to display indicia 12 on a substantially planar display 13, such as a section of printed card stock, a stiff section of plastic sign material, a flat sign that includes chemiluminescent self illumination, or other display having a substantially flat edge. The system 10 is shown mounted in a vehicle 14. It is important to note that while the system 10 has been shown mounted on the inside of a vehicle, it is contemplated that the system may be used to support and display indicia on any of many flat surfaces, such as the surface of a refrigeration device, a shelf at a supermarket, a mirror in a home, a window at a business or office, or on the interior or exterior of a vehicle.

Figure 2:
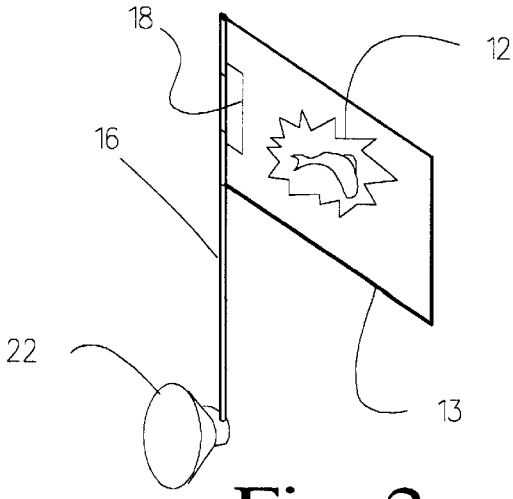
FIG. 2 is a perspective view of the system.
Figure 3:
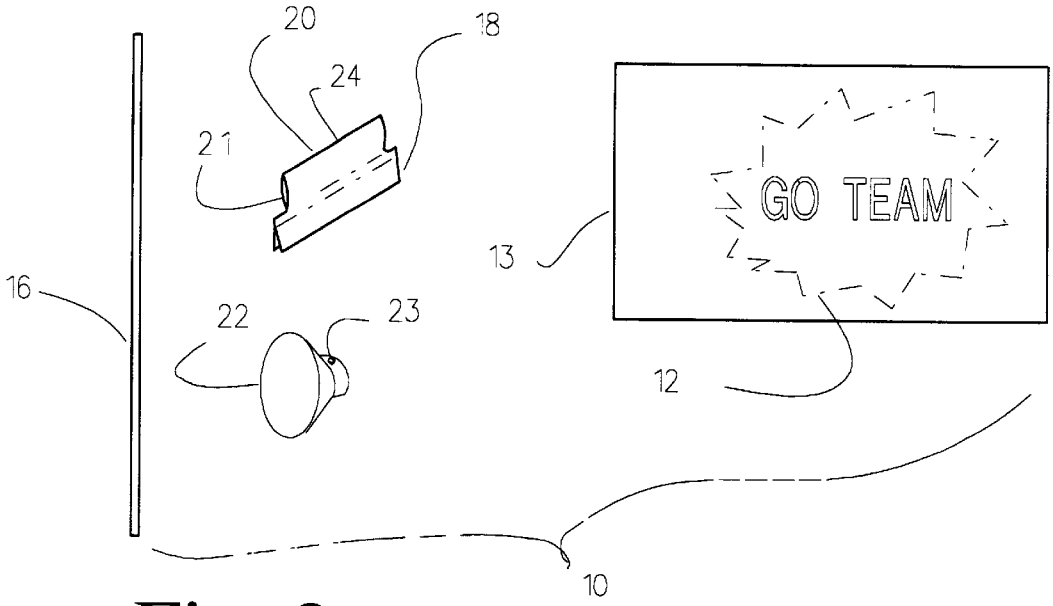
FIG. 3 shows the basic components of the system.
Figure 4:
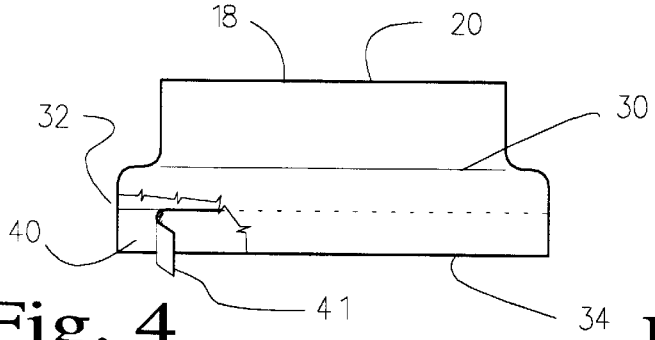
FIG. 4 is a side elevational view of the means for supporting the display or sign on the resilient rod, the view including a breakout section to show the peel away cover over the adhesive on the inside surfaces of the opposing legs.
Figure 5:
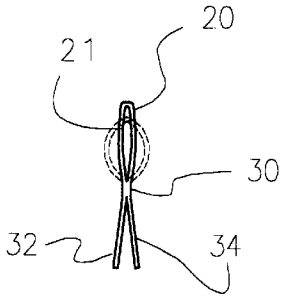
FIG. 5 is an end view of the means for supporting the display on the resilient rod, the view illustrating the deformation of the means for supporting the display on the resilient rod when the resilient rod is inserted.

Refer now to FIGS. 2–3, where it has been illustrated that the system 10 includes the substantially planar display 13, which may be one of many interchangeable displays to be used with the system. The display 13 is mountable on a resilient rod 16 by means of a resilient support means 18 which supports the planar display 13 from the resilient rod 16. In a highly preferred embodiment these resilient support means are similar to commercially available index tabs made by Avery Dennison company, Avery Office Products Division, having offices in Azusa, Calif., Flowery Branch, Ga., and Schaumburg, Ill. The commercially available index tabs have been designed and used for supporting a label against a heavy stock divider for separating and identifying sections in a loose-leaf binder.

Therefore, while it is contemplated that commercially available index tabs may be used to practice the instant invention, it is clearly contemplated that the invention could be practiced with a resilient support means 18 that includes a sleeve portion 20 and a longitudinal aperture 21 which has been adapted for receiving the resilient rod 16 and providing a tight fit between the resilient rod 16 and the sleeve 20. Thus, the invention may be practiced with a resilient support means that resembles, but is not specifically manufactured as, an index tab. For example, the resilient support means may extend the entire length of the display to be supported, or the sleeve portion may be smaller than would be required to hold a legible label.

Once the substantially planar display 13 has been attached to the resilient support means 18, and the resilient support means 18 has been mounted on the resilient rod 16, the resilient rod 16 may be mounted on a substantially flat surface by means of a suction cup 22, which includes an aperture 23 or other means for accepting and holding the resilient rod 16 on the suction cup 22. While the preferred embodiment includes the suction cup 22, it is contemplated that many other equivalent support means for supporting the resilient rod 16 against a substantially flat surface may be used. However, the use of a suction cup 22 is preferred due to the fact that it will not require the use of glues or other attachment means which may harm the surface on which the system is mounted.

Thus it can be appreciated that the use of the suction cup 22 to mount the system onto a surface allows the user to quickly remove the system from a surface without damaging the surface. Furthermore, it is well known that the pull-off and shear strength achieved through a suction cup is more than adequate to support the signage, but the suction cups offer the added advantage of being removable without damaging the mounting surface. Therefore by combining light, resilient components disclosed herein, it is possible to produce a highly effective display system that may be mounted and effectively displayed on any smooth flat surface, without using chemical adhesives or other mechanical fasteners.

Refer now to FIGS. 4–7, where it has been illustrated that the resilient support means 18 is preferably made from a sheet of resilient material, such as plastic, rubber, or the like. The sheet of resilient material is preferably folded so as to define a fold line 24 dividing the material into a first section 26 and a second section 28. The first section 26 and second section 28 are then joined together along a seam line 30, which divides the first section 26 to include a first leg 32, which extends from the seam line 30. Similarly, the second section 28 is also divided by the seam line 30 to define a second leg 34. The area between the seam line 30 and the fold line 24 is the sleeve 20 described above.

Each leg has a face that opposes a face on the other leg. Thus as illustrated on FIG. 7, the first leg 32 includes a face 36 and the second leg 34 includes an opposing face 38. As can be seen from FIGS. 4 and 7, each face 36 and 38 includes at least one section of adhesive material 40. The adhesive material 40 will preferably be protected by a peel away cover 41, which protects the adhesive surface until it is to be used against a substantially planar display 13 to be supported in the resilient support means 18. Clearly, it is contemplated that a single section of adhesive material may be used on only one of the faces of the legs. However, the use of a section of adhesive on each face of the legs allows for a stronger, symmetrical and balanced grip of the substantially planar display 13. The advantage of producing a balanced and symmetrical connection is that the balance of forces prevents deformation of the display. Moreover, it has been discovered that this balanced support prevents the undesired unraveling of the adhesive from the planar display 13.

As shown on FIG. 6, the resilient rod 16 fits within the sleeve 20 of the resilient support means 18. The sleeve should be adapted for deflecting as the resilient rod 16 is inserted into the sleeve 20 through the longitudinal aperture 21, thus providing an interference fit between the sleeve 20 and the resilient rod 16. Alternatively, if the sleeve 20 is used with a resilient rod 16 which does not allow proper interference fit, it is contemplated that the system include a shim 42, further illustrated in FIG. 9, and which may be inserted into the sleeve as shown on FIG. 6 and FIG. 6A to further increase the strength of the interference fit between the sleeve 20 and the resilient rod 16. It is important to note that the shim 42 can be a generally arched section of resilient material, or may be made of a hollow or solid resilient material having a generally rounded cross section as shown in FIG. 9.

It is preferred that the resilient rod 16 be made from a translucent material of a fluorescent color. The translucent material having an index of refraction that allows the capture of light within the resilient rod 16, in order to further enhance the ability of the system to draw an observer's attention. Also, it is contemplated that a chemiluminescent material 50 may be incorporated into the resilient rod 16, as shown on FIG. 9.

Also shown on FIG. 6 are a pair of vectors 44, which represent the balanced, equal reaction forces imposed by the sleeve 20 on the resilient rod 16. The original, undeformed shape of the sleeve 20, is shown in dashed lines. It can be appreciated from FIG. 6 that the inherent balance and symmetry produced by the use of the resilient support means 18 discussed herein will produce new, useful, and unexpected results which could not be achieved with the known prior art. Of particular importance is the fact that the disclosed system produces uniform, easily reproduced results in improved alignment and balance of the display 13 relative to the resilient rod 16. The structure supports the display in a symmetrical fashion relative to the rod 16, and thus produces an inherently stable, balanced arrangement with consistent high quality and uniform appearance.

Refer now to FIG. 7 it can be seen that the substantially planar display 13 includes opposing faces 46, and 47, to which the adhesive material 40 on the opposing faces 36 and 38 of the first leg 32 and the second leg 34 may attach. As shown on FIG. 7, the first leg 32 and the second leg 34 accept the substantially planar display in a registered relationship between the opposing face 36 and 38. The arrows 39 indicate the direction of flexing of the first leg 32 and the second leg 34 in order to grip planar display 13 between the legs.

It has been discovered that by using a resilient support means 18 that includes the features described herein one can achieve new, useful, unexpected results which were heretofore unknown. A very important result can be understood by inspecting FIG. 6, which allows those skilled in the art to understand that the system will support the substantially planar display 13 in a symmetrical manner, which will allow unimpeded observation of the planar display 13 from either side of the display. Also, it will be understood that since the disclosed system does not permanently attach the planar display against the resilient rod 16, the system 10 will allow the user change the display on the resilient rod without having to change the entire rod assembly. This is an important advantage since this enables the system 10 to be used in situations where the message indicia on the planar display 13 needs to be varied frequently.

Also of importance is the fact that it has been discovered that the use of the resilient support means 18 as part of a display system 10 results in easy, consistent alignment of the planar display 13 on the resilient rod 16. Also, as compared to simply wrapping a flag or other flexible display on a rod, the system 10 places and supports the planar display 13 in an essentially parallel, centered, balanced and aligned orientation with the resilient rod 16. As shown on FIGS. 7A and 7B, it has been found that this balanced support results in a balancing of forces on the display and produces a more durable attachment, eliminating any tendencies to unravel or warp the display. Moreover, as explained above, this greatly improves the visibility of all of the indicia being displayed, as well as provides a neat, durable and orderly appearance to the displays.

Refer to FIGS. 7A and 7B it can be understood that the use of a balanced and symmetrical support system can produce a stable, aligned support of a flat display. In FIG. 7A a single attachment 100 has been shown on a planar display 13. The effects of thermal expansion and contraction, general wear and tear, as well as the effects of chemical decomposition due to exposure to the sun and the atmosphere will produce a dimensional change in the attachment 100. This imposes force labeled 102 onto the planar display 13, causing a bending or warping and altered alignment in the direction of arrows 104. FIG. 7B illustrates that by using a balanced and symmetrical structure, one can effectively cause the forces 102 to cancel each other out, adding stability to the assembly and eliminating the tendency to warp or bend the planar display 13.

According to yet another aspect of the invention, a method for creating and mounting displays has been discovered. The method includes the steps of providing at least one substantially planar display 13, a resilient rod 16, means for supporting the resilient rod against a support surface, such as the suction cup 22, and a resilient support means 18 for supporting the planar display from the resilient rod 16. This step is followed by the step of placing the planar display 13 against the section of adhesive material 40 of each of the legs 36 or 38 of the resilient support means 18. Once the planar display 13 is placed against the section of adhesive material 40, the user then presses the section of adhesive material 40 against the planar display 13, so that the two opposing faces 36 and 38 adhere to the planar display 13. After the display 13 has been mounted on the resilient support means 18, then the resilient rod 16 may be inserted into the aperture 21 defined in the sleeve 20 of the resilient support means 18.

Refer now to FIG. 8, where it has been illustrated that the system 10 may be used with one of many commercially available graphics computer programs to be run on a personal computer 46 to create customized indicia on the substantially planar displays to be held with the system 10. Clearly, it is contemplated that the system may be sold together with a computer program that is specifically adapted for creating indicia for the substantially planar display 13, and printing the indicia on the substantially planar display 13 by means of a commercially available printer 48.

FIG. 10 illustrates that a possible assortment of signs or displays may be sold as part of a pre-prepared kit for assembling a display in accordance with the principles taught herein. By providing a kit with a variety of displays, the user may select a desired display from the assortment of planar displays provided in the kit. This avoids the need to use a computer and printer for placing indicia on the planar displays 13.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A system for displaying indicia, the system comprising:

at least one interchangeable substantially planar display;

a resilient support means for supporting said planar display, said resilient support means comprising:

a first substantially planar sheet of resilient material, the first sheet of resilient material having a first edge and a second edge; and a second substantially planar sheet of material, the second sheet of material having a first edge and a second edge, the first edge the first sheet of resilient material being connected to the first edge of the second sheet of material, and the second edge of the first sheet of resilient material being connected to the second edge of the second sheet of material in order to define a substantially flat open sleeve having a longitudinal aperture extending through between the first sheet of resilient material and the second sheet of material; and means for supporting said substantially planar display extending from said flat open sleeve; and means for supporting said resilient support means against a support surface, the means for supporting said resilient support means having opposing sides and being adapted for insertion into the longitudinal aperture, so that insertion of the means for supporting the resilient support means into the longitudinal aperture bows said sheets sheets of resilient material, urging the first sheet of resilient material and the second sheet of resilient material against the opposing sides of said means for supporting said resilient support, so that said first sheet and said second sheet impart opposing forces creating substantially linear contact of said first sheet of material and said second sheet of material on the opposing sides of said means for supporting, thereby retaining the means for supporting said resilient support within said sleeve.

2. A system according to claim 1 wherein said means for supporting said substantially planar display extending from said flat open sleeve comprises:

a first leg and a second leg, each leg having a face that opposes the face on the other leg, each face having at least one section of adhesive material.

3. A system according to claim 2 wherein the first edge the first sheet of resilient material and the second edge of the first sheet of resilient material are substantially parallel to one another and the first leg and the second leg are attached to one another along at least two points defining a line that is substantially parallel to the first edge and the second edge of the first sheet of resilient material.

4. A system according to claim 3 wherein said means for supporting said resilient support means against a support surface comprises a resilient rod.

5. A system according to claim 4, wherein said resilient rod is made from a translucent fluorescent material.

6. A system according to claim 4 and further comprising means for supporting said resilient rod against a support surface.

7. A system for creating displays, the system comprising:

at least one substantially planar display having opposite sides and an edge;

a resilient rod having opposite sides;

resilient support means for supporting said planar display from said resilient rod, the resilient support means comprising:

a first substantially planar sheet of resilient material, the first sheet of resilient material having a first edge and a second edge; and a second substantially planar sheet of material, the second sheet of material having a first edge and a second edge, the first edge the first sheet of resilient material being connected to the first edge of the second sheet of material, and the second edge of the first sheet of resilient material being connected to the second edge of the second sheet of material in order to define a generally flat open sleeve having a longitudinal aperture extending through between the first sheet of resilient material and the second sheet of material, the aperture being adapted for receiving said resilient rod through the sleeve, so that insertion of the resilient rod into the longitudinal aperture bows said sheets of resilient material, urging said sheets of resilient material against said opposite sides of said resilient rod, so that said first sheet and said second sheet bow to impart a force alone a line on the opposite sides of said resilient rod, thereby retaining the resilient rod within said sleeve; and means for supporting said planar display extending from said sleeve; and means for supporting said resilient rod against a support surface.

8. A system according to claim 7 wherein said means for accepting said planar display comprises at least one section of adhesive material that is substantially parallel to the first edge and the second edge of the first sheet of resilient material.

9. A system according to claim 8 and further comprising at least one flexible shim means for insertion between said sleeve and said resilient rod in a registered relationship within between said sleeve and said resilient rod, so that said shim means cooperates with said sleeve and said resilient rod by augmenting deflection of said first sheet and said second sheet when the resilient rod is inserted into the sleeve.

10. A system according to claim 8 wherein said resilient support rod is made from a fluorescent material.

11. A system according to claim 8 wherein said resilient support rod is of a translucent material.

12. A system according to claim 8 wherein said means for supporting said resilient rod against a support surface comprises a suction cup.

13. A method for creating displays, the method comprising:

providing at least one substantially planar display, means for supporting said planar display, and a resilient rod having opposing sides;

supporting the means for supporting said planar display from said resilient rod by exerting forces on opposite sides of the rod, the forces on opposite sides of the rod provided by the means for supporting the planar display, the means for supporting the planar display comprising:

a first substantially planar sheet of resilient material, the first sheet of resilient material having a first edge and a second edge; and a second substantially planar sheet of material, the second sheet of material having a first edge and a second edge, the first edge the first sheet of resilient material being connected to the first edge of the second sheet of material, and the second edge of the first sheet of resilient material being connected to the second edge of the second sheet of material in order to define a substantially flat open sleeve having a longitudinal aperture extending through between the first sheet of resilient material and the second sheet of material, the longitudinal aperture being adapted for receiving the resilient rod, so that insertion of the resilient rod bows the sheets of resilient material, urging the sheets of resilient material against the resilient rod, thereby imposing forces substantially along a line against the opposing sides of the rod; and at least one leg that includes a section of adhesive material in a substantially parallel fashion to the first edge of the first sheet of resilient material; and placing the planar display against the section of adhesive material of the leg of the resilient support means.

14. A method according to claim 13 and further comprising the steps of providing at least one shim means adapted for insertion into the sleeve, and inserting the shim means into the sleeve together with the resilient sleeve to adjust the amount of bowing of the first sheet of resilient material, so that the force on the side of the resilient rod may be increased by increasing the bowing of the first sheet of resilient material.

* * * * *